US007504602B2

(12) United States Patent
Röhr et al.

(10) Patent No.: US 7,504,602 B2
(45) Date of Patent: Mar. 17, 2009

(54) SUSPENDED CONTROL DEVICE

(75) Inventors: Michael Röhr, Dortmund (DE); Udo Gersemsky, Herdecke (DE); Wolfgang Krebs, Wetter (DE); Anton Münzebrock, Dortmund (DE); Rüdiger Ostholt, Wetter (DE); Giuliano Persico, Wetter (DE); Erik Appel, Wetter (DE); Oliver Ullrich, Bochum (DE); Burkhard Hasenack, Hagen (DE); Holger Freitag, Bochum (DE); Jürgen Heun, Dortmund (DE)

(73) Assignee: Demag Cranes & Components GmbH, Wetter (DE)

( * ) Notice: Subject to any disclaimer, the term of this patent is extended or adjusted under 35 U.S.C. 154(b) by 458 days.

(21) Appl. No.: 10/520,551

(22) PCT Filed: Jun. 30, 2003

(86) PCT No.: PCT/EP03/06923

§ 371 (c)(1),
(2), (4) Date: Aug. 18, 2005

(87) PCT Pub. No.: WO2004/007334

PCT Pub. Date: Jan. 22, 2004

(65) Prior Publication Data

US 2006/0180562 A1 Aug. 17, 2006

(30) Foreign Application Priority Data

Jul. 10, 2002 (DE) ..... 102 31 798
Oct. 16, 2002 (DE) ..... 202 16 079 U

(51) Int. Cl.
*H01H 13/14* (2006.01)
*H01H 19/04* (2006.01)

(52) U.S. Cl. ..... 200/298; 254/360; 414/4

(58) Field of Classification Search ..... 200/298, 200/293, 331, 17 R; 254/270, 274, 360–362; 414/4, 5

See application file for complete search history.

(56) References Cited

U.S. PATENT DOCUMENTS 3,237,780 A 3/1966 Burnett ..... 212/26
4,042,213 A * 8/1977 Schreyer et al. ..... 254/270
4,520,247 A * 5/1985 Pancook et al. ..... 200/298

(Continued)

FOREIGN PATENT DOCUMENTS

DE 1819497 7/1960

*Primary Examiner*—Kyung Lee
(74) *Attorney, Agent, or Firm*—Van Dyke, Gardner, Linn & Burkhart, LLP

(57) ABSTRACT

The invention relates to a suspended control device (20) which is suspended by means of a control line (1, 24) connected to a unit to be controlled (21). Said suspended control device is especially a control switch or a suspended push-button switch for controlling hoisting equipment, the control line (1, 24) comprising electrical lines (2) for transmitting control signals, and a traction relief element (22) which is supported at the top, on the unit (21), and used to absorb weight and tractive forces. The aim of the invention is to provide a suspended control device (20) whereby the length of the control line (1, 24) can be easily changed. To this end, a storage element for receiving and releasing a defined length of the electrical lines (2) is provided behind the region wherein the traction relief element (22) is supported, seen in the direction of the unit (21) from the suspended control device (20).

28 Claims, 9 Drawing Sheets

U.S. PATENT DOCUMENTS 4,557,659 A * 12/1985 Scaglia ..... 414/627
4,635,903 A * 1/1987 Broyden et al. ..... 254/362
5,507,472 A * 4/1996 Bitsch et al. ..... 254/264
5,615,704 A * 4/1997 Sell ..... 137/596.1
6,525,282 B2 * 2/2003 Krebs et al. ..... 200/298
6,554,533 B2 * 4/2003 Godbersen ..... 405/3
6,886,812 B2 * 5/2005 Kazerooni ..... 254/270

* cited by examiner

SUSPENDED CONTROL DEVICE

BACKGROUND OF THE INVENTION

The invention concerns a suspended control device, which is suspended from a unit being controlled via a control line, especially a control switch or a suspended pushbutton switch for controlling a hoisting machine, according to the preamble of Claim 1.

Suspended control devices in the form of a suspended pushbutton switch are known, for example, from EP 0 592 795 A1 and DE-OS 26 03 409, which serve to control the upward and downward movement of a hoisting machine situated above an operator person. The suspended pushbutton switches have a housing, on which a row of pushbuttons are arranged. The switch housing is connected at its upper end via a connection cable to the hoisting machine. The connection cable has a sheath, in which are arranged the electrical control line for transmission of control signals and a traction relief in the form of a steel cable or a metal cable. The traction relief serves to absorb gravity and traction forces and is fastened above to the hoisting machine. Traction forces arise in particular when the operator person pulls transversely on the switch housing in order to move the hoisting machine, which can travel on a beam. For this, a corresponding handle can be provided on the switch housing. On the other hand, the sheath itself can also consist of a solid plastic, so that it can serve additionally as a grip element for the operator.

The drawback of the known suspended control devices consists in that they generally cannot be lengthened. It is only possible to shorten the cable, which furthermore is very time-consuming. Once the length of the connection cable is chosen, one often has to make do with it, despite the poor serviceability.

SUMMARY OF THE INVENTION

The purpose of the invention is to indicate a suspended control device in which the control line can be changed in its length with little expenditure.

The purpose is achieved by the features of Claims 1, 14, 19 21 and 26. The subsidiary claims contain advantageous configurations of the suspended control device.

A first solution provides a storage for the electrical lines to take up and pay out a predetermined line length, being located after the support point of the traction relief, looking in the direction from the suspended control device to the unit.

Furthermore, it is provided that the traction relief be formed from a flat foldable hose in the manner of a textile hose and the electrical lines travel through the inside of the hose and the hose can be folded up and stored along with the electrical lines in the storage. The use of such a "textile" hose now makes it possible to economically store the portion of the control line not needed for the required length, together with the electrical lines, without having to sacrifice an effective traction relief and an easy gripping of the control line, especially for pulling the unit being controlled. When the hose can be folded up and stored together with the electrical lines in the storage, i.e., folded in the lengthwise and transverse volume, the result is a smaller storage volume.

The gripping of the control line is improved by filling the hose with an elastic material, at least in the area of the gripping of the operator.

It is structurally simple to form the elastic material by a lengthwise slit hollow cylinder, through whose cavity travel the electrical lines or the cable, if they form a cable.

As an alternative, it is also possible to lead the hose through a hollow cylinder made from an elastic material in the gripping region of the operator.

An economical solution calls for the elastic material to be formed from a foam plastic.

In order to assure a long life to the hose, it is proposed that the hose be supported on the unit via a supporting device, which uniformly distributes the gravity and traction forces over the periphery of the hose.

A simple and effective supporting device is formed from a truncated cone, arranged inside the hose, with a continuous opening for the electrical lines and an inner funnel arranged outside the hose and supported against the unit, corresponding to the external shape of the truncated cone, the truncated cone being pulled by the gravity and traction forces into the funnel and thus axially securing the hose against the unit.

As an alternative, it is advantageous for at least part of the funnel to be part of the unit.

For easy assembly, it is proposed that the truncated cone and the funnel each be divided lengthwise and formed from two mating halves.

To allow for loosening the fastening of the hose to the unit, it is proposed that the support device have an element by which the truncated cone can be pushed upward by pressing on the hose from the outside, for which the element is provided with inwardly directed lugs which engage the truncated cone.

Advisedly, the funnel has a lengthwise guide for the outward movable element.

In order to take up the unneeded control line, it is proposed to provide a storage for the electrical lines above the supporting device.

A second solution provides a storage for the electrical lines to take up and pay out a predetermined line length, situated between the suspended control device and the unit, being configured in that the cablelike traction relief and the electrical lines are led downward, at a lower turnaround point back up again at least once, and there again downward via a turnaround element to the suspended control device and are connected to it, and the cablelike traction relief and the electrical lines are clamped together at the lower turnaround point by means of a clamp which can be loosened.

A third solution calls for configuring the cablelike traction relief and the electrical lines as a common cable, which is detachably fastened at a support element arranged on the unit, in that the support element has two neighboring continuous openings with a land element situated in between, in order to lead the cable through the two continuous openings for self-clamping fixation.

A fourth solution provides a storage for the electrical lines to take up and pay out a predetermined line length, located between the suspended control device and the unit, being configured such that the electrical lines are led inside an essentially vertical tube fastened to the unit, having a telescopic extending inner tube, to which the suspended control device is fastened, and both bendable tubes are made of plastic.

A fifth solution calls for the cablelike traction relief and the electrical lines to be fashioned as a common flat cable, and a storage for the cable for taking up and paying out a predetermined line length is located between the suspended control device and the unit, configured such that the cable is wound around a carrying element in the form of a winding frame.

BRIEF DESCRIPTION OF THE DRAWINGS

A sample embodiment of the invention shall now be described by means of a drawing. This shows.

DETAILED DESCRIPTION OF THE PREFERRED EMBODIMENT

Figure 1:
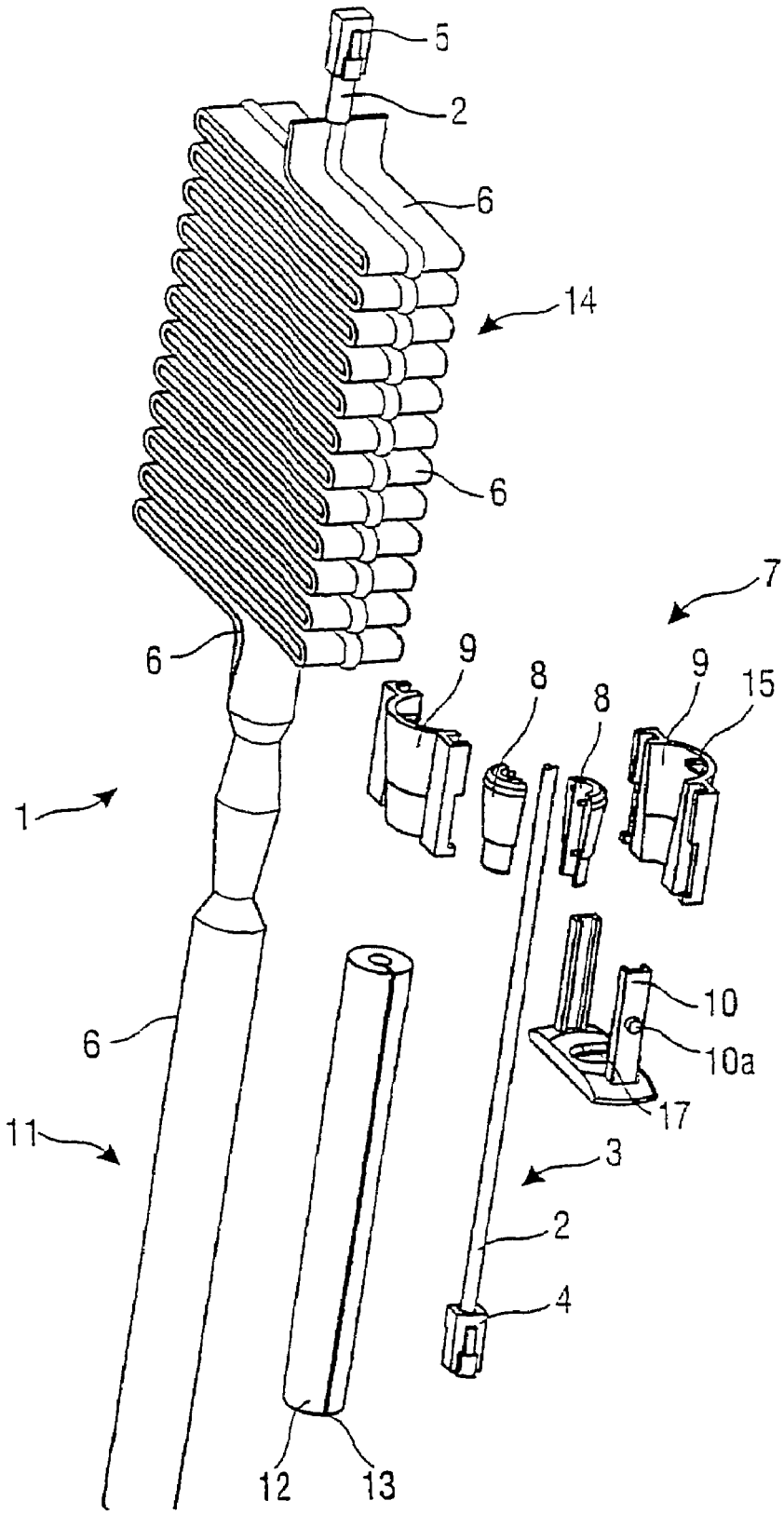
FIG. 1 is a control line in three-dimensional representation, as well as the supporting device with the electrical lines in an exploded view.

FIG. 1 shows a control line 1 of a suspended control device 20 (see FIG. 5) for the control signals of a unit 21 being controlled (see FIG. 5), wherein the suspended control device is fastened at the bottom to the control line 1, as illustrated in FIG. 1. The suspended control device 20 can be a control switch with a row of pushbuttons, used for example to move a hoisting machine up and down.

The control line 1 has electrical lines 2 in the form of a cable 3, at each of whose ends electrical connectors 4, 5 are secured. The electrical lines 2 in the form of a cable 3 serve to transmit control signals from the suspended control device 20 to the unit 21 being controlled, i.e., the hoisting machine in this case. Of the cable 3 with the electrical lines 2, only the lower portion is shown in FIG. 1. Besides the cable 3, the control line 1 comprises a traction relief in the form of a flat foldable hose 6 in the manner of a textile hose. The hose 6, like a textile hose, can consist of woven or braided fabric. The textile material can be a plastic, as well as natural textile materials. The outer diameter of the cable 3 stands to the inner diameter of the hose 6 in a relation of at least 1:3, here, 1:5. The hose 6 is supported at the top on the unit 21 via a supporting device 7, which is formed from a truncated cone 8 and a corresponding (inner) funnel 9, the truncated cone 8 being located inside the hose 6. By means of an element 10, the truncated cone 8 can be moved somewhat upward relative to the stationary funnel 9 from the outside, in order to loosen once again the connection between the hose 6 and the unit 21. In the grasping region 11 of the operating person, there is located inside the hose 6 a hollow cylinder 12, consisting of a solid elastic material and thus forming a firm handle and at the same time a protection for the electrical lines 2; the solid elastic material can also extend across the entire lower length of the hose. The electrical lines 2 travel through its continuous opening, while a lengthwise slit 13 enables an easier inserting of the electrical lines 2 and cable 3 into the hollow cylinder. In the grasping region 11 of the operating person, the hose 6 is filled with an elastic material. The elastic material is an elastic foam plastic with appropriate strength.

The entire traction relief to absorb the gravity and traction forces which occur is provided solely via the hose 6.

As an alternative, the hose 6 with the cable 3 running on the inside can also itself travel through a hollow cylinder made from an elastic material, which can thus also enclose the hose 6 on the outside.

Figure 2:
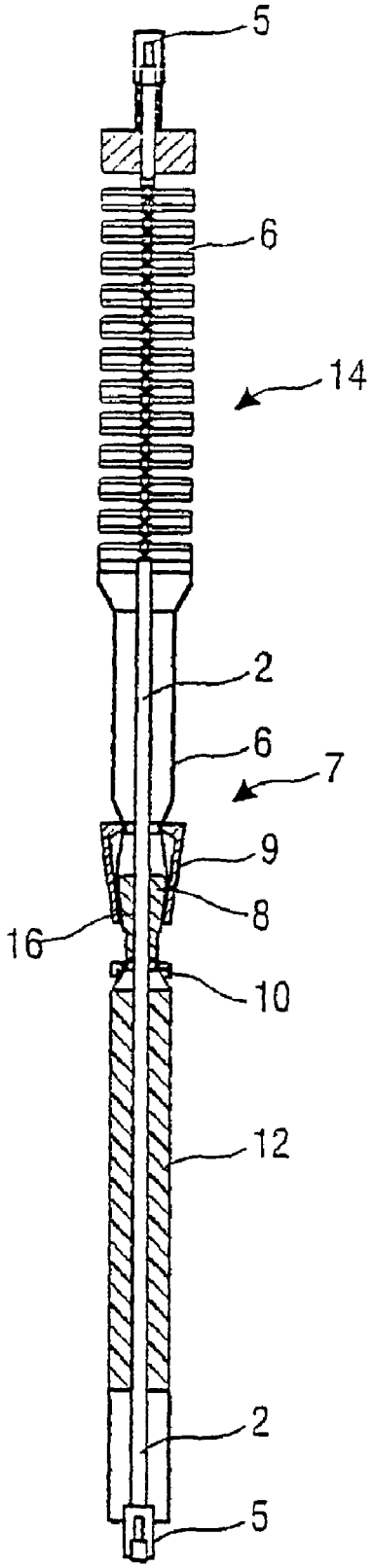
FIG. 2 is a side elevation of the control line per FIG. 1, partly cut away.
Figure 3:
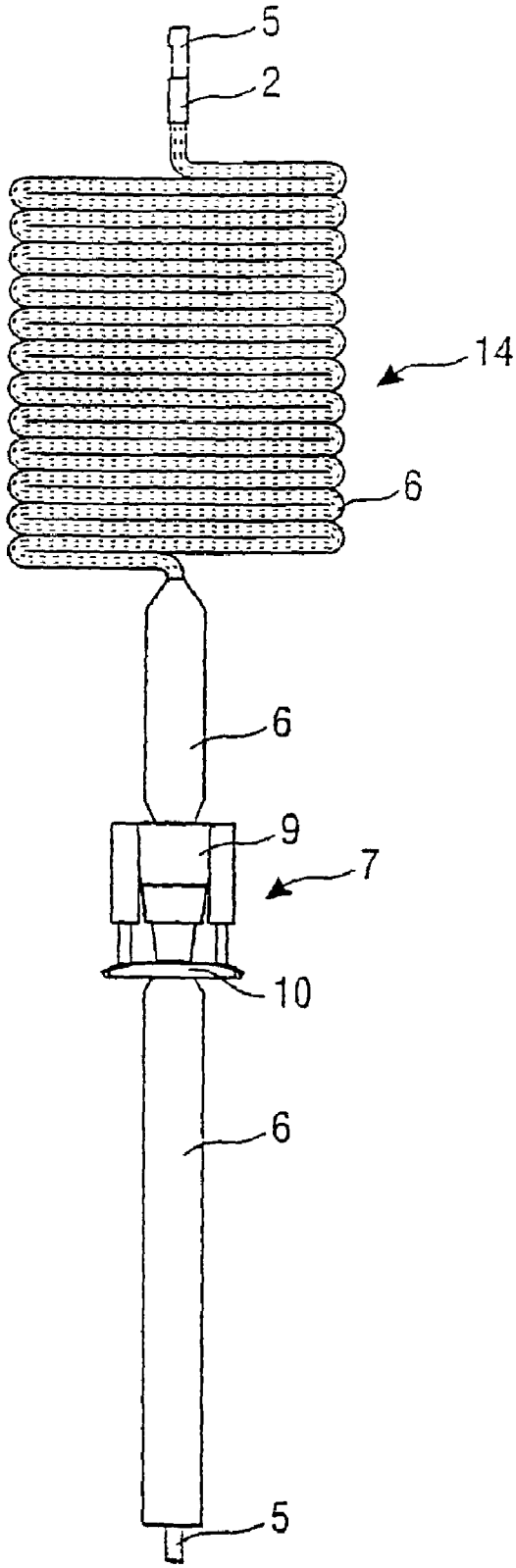
FIG. 3 is a front elevation of the control line of FIG. 1.

FIG. 2 shows a partially sectioned side view of the control line 1; FIG. 3 shows the corresponding front view. In particular, FIG. 2 reveals the cable 3 with the lines 2 running from bottom to top, being laid together flat and folded with the surrounding hose in the upper region and thus forming a cable storage 14.

Furthermore, FIG. 2 shows the supporting device 7 in operation, uniformly distributing the gravity and traction forces on the periphery of the hose. Thus, the truncated cone 8 formed from the two halves is located inside the hose 6. Its downward displacement is limited by the funnel 9 and its upward displacement by a lug 15 (see FIG. 1) on the funnel 9. As FIG. 1 shows, the element 10 is led in the funnel 15 by means of the guide pins 10*a*. The funnel 9 is firmly supported against the unit 21, i.e., the hoisting machine, so that when traction forces occur, the truncated cone 8 is pulled downward, thereby securing the hose axially in relation to the funnel 9. The truncated conical shape must, of course, correspond to the inner funnel of the funnel 9. In this way, gravity and traction forces are distributed uniformly about the periphery of the hose.

The truncated cone 8 is provided with a continuous opening 16, through which travels loosely the cable 3 with the electrical lines 2. If the element 10 is pushed upward, it carries along the truncated cone 8 through the hose 6, so that the connection between truncated cone 8 and funnel 9 is again loosened. It is then possible to ease off the tube 6 with the cable 3 from the storage 14 at the top and, with the truncated cone 8 pushed up, to pull it downward through the supporting device 7, enabling an easy lengthening of the control cable 1.

Vice versa, the control cable 1 can also be shortened in this way.

Figure 4:
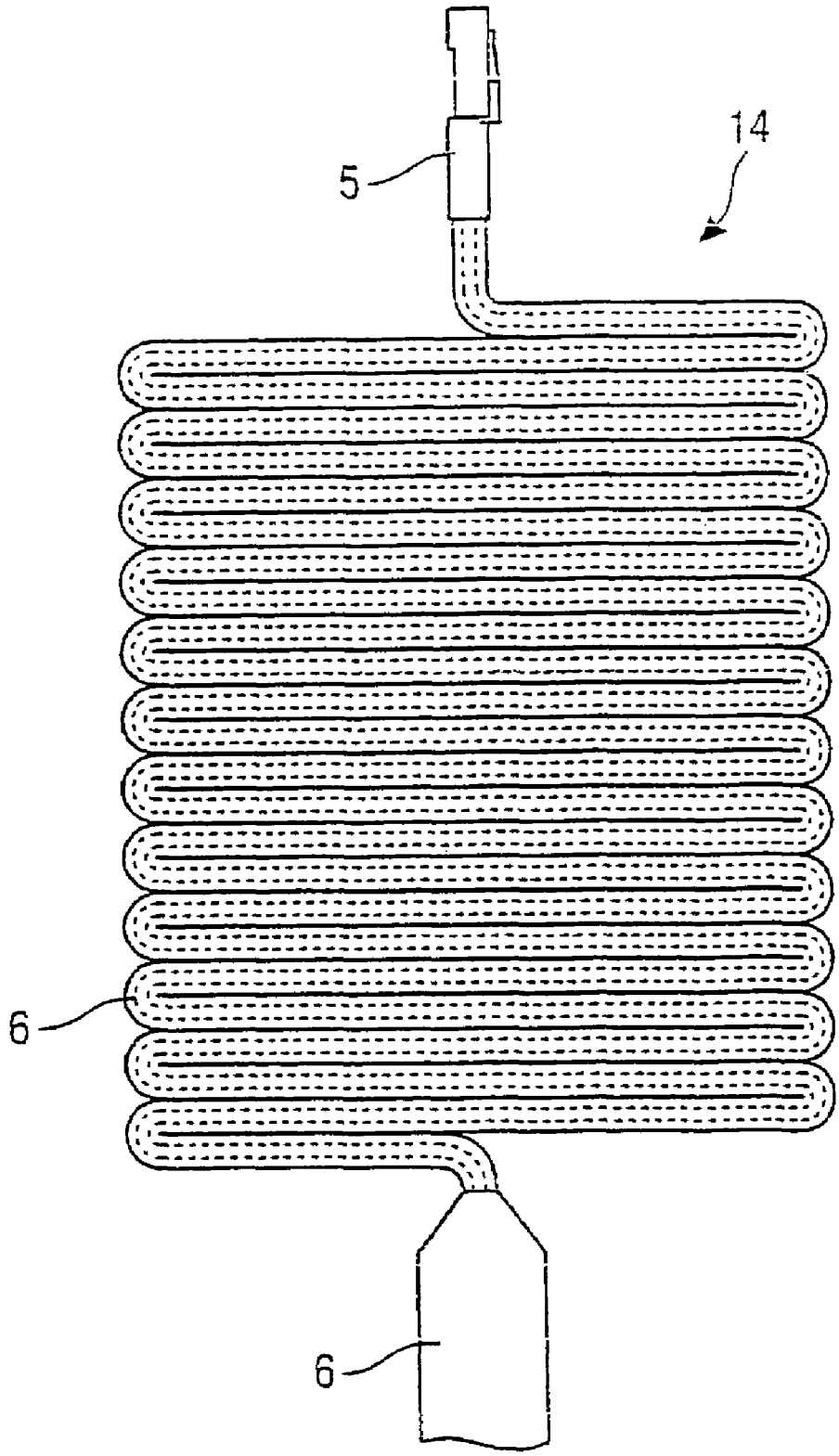
FIG. 4 is an enlarged representation of the cable storage per FIG. 1.

FIG. 4 shows the storage 14 yet again in an enlarged view.

Figure 5:
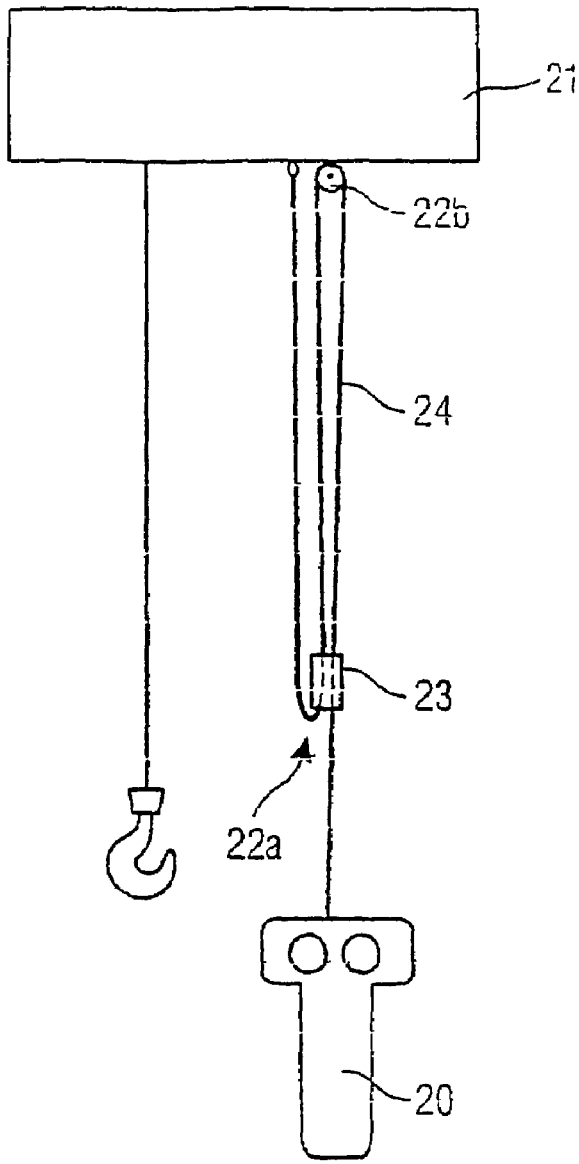
FIG. 5 is a schematic representation of a suspended control device.

FIG. 5 shows schematically another suspended control device 20, which is suspended by a control line 24 from a unit 21 being controlled. The control line 24 in the form of a flat cable comprises electrical lines 2 for transmission of control signals and a traction relief 22 at both ends of the cable in the form of steel ropes, which together with the cable are supported on top at the unit 21. The control line 24 is led down from the unit 21, back up again at a lower turnaround point 22*a*, and once more down across a turnaround element 22*b* in the form of a roller to the suspended control device 20. The control line 24 is clamped together by means of a detachable clamp 23 in the region of the lower turnaround point 22*a*.

Figure 6:
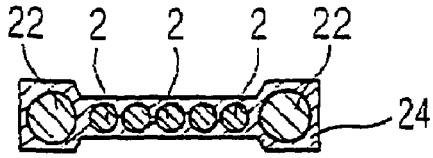
FIG. 6 is a sectional view taken through the control line of FIG. 5.

FIG. 6 shows the cross section of the control line 24.

Figure 7:
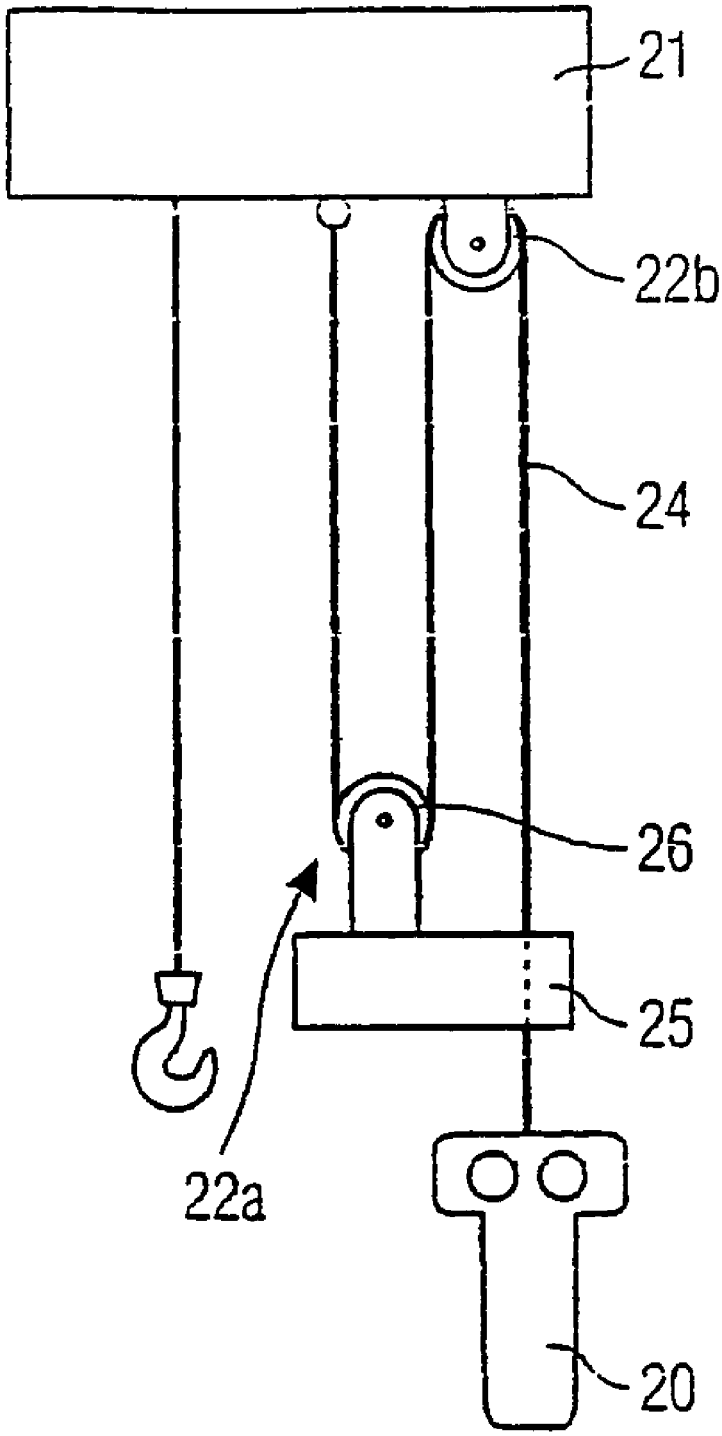
FIG. 7 is a schematic representation of the suspended control device per FIG. 5.

FIG. 7 shows a configuration of the suspended control device 20 of FIG. 5, wherein a deflection roller 26 operating under force of gravity forms the lower turnaround point 22*a* and the turnaround element 22*b* is likewise fashioned as a deflection roller. Here, the flat cable end connected to the suspended control device 20 is at the weight element 25 producing the gravity. For this, the flat cable end is led through a continuous opening provided at the weight element 25.

Figure 8:
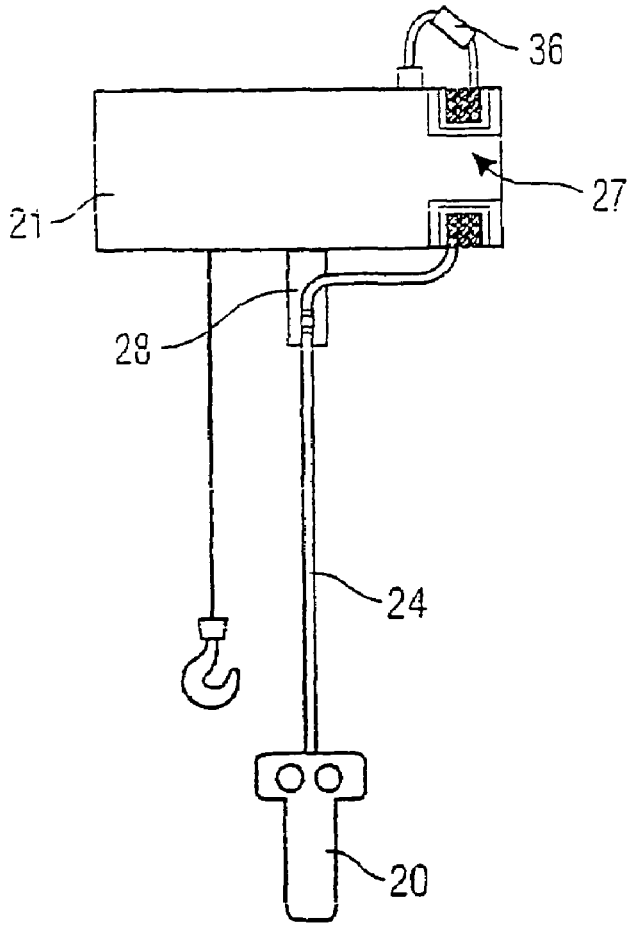
FIG. 8 is an illustration of a suspended control device with a common cable with circular cross section.

In the suspended control device 20 of FIG. 8, the cablelike traction relief 22 and the electrical lines 2 as the control line 24 are again configured as a common cable with circular cross section, being detachably fastened to a platelike support element 28 arranged on the unit 21. The cable storage 14 here is a freely turning cable drum 27 as part of the unit 21, which is connected by means of a plug connection 36 to the electrical lines 2.

Figure 9:
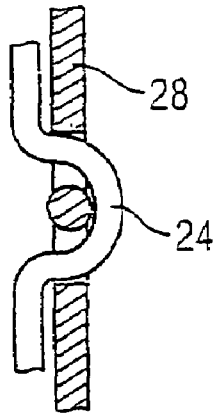
FIG. 9 is an enlarged representation of the supporting element per FIG. 8.

As FIG. 9 shows, the support element 28 has two neighboring continuous openings with a land element in between, around which the cable traveling through the two continuous openings is led for self-clamping fixation.

Figure 10:
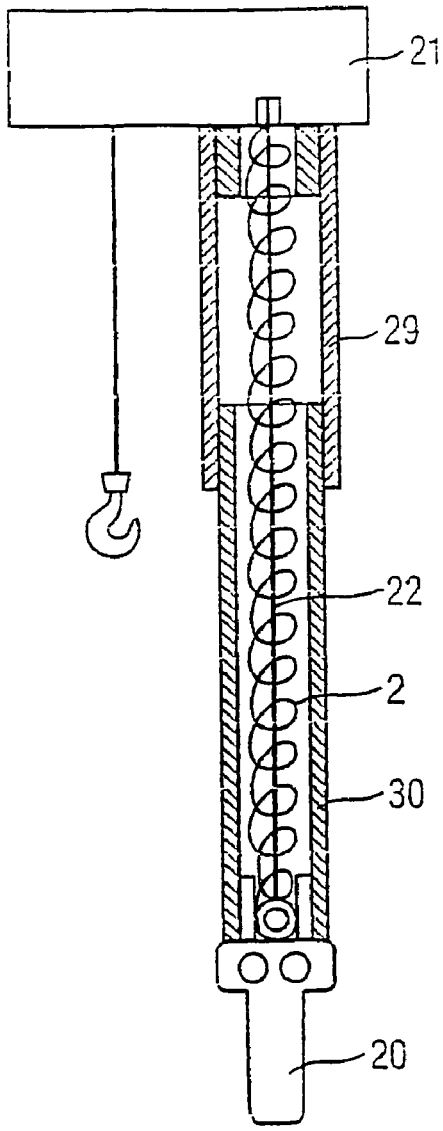
FIG. 10 is an illustration of a suspended control device of telescopically extending tubes.

Another suspended control device 20 is shown schematically in FIG. 10. The storage for the electrical lines 2 provided between the suspended control device 20 and the unit 21 is formed in that the electrical lines 2 are led on the inside of an essentially vertical tube 29 fastened to the unit 21, having a telescopically extending inner tube 30 to which the suspended control device 20 is fastened, and the two flexible tubes 29, 30 are made of plastic. The electrical lines 2 have a spiral shape here. The traction relief 22 is a steel rope which can be secured.

Figure 11:
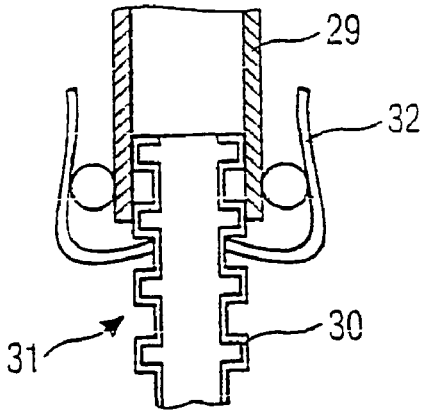
FIG. 11 is an enlarged representation of the inner tube per FIG. 10 with undercuts for hook elements.

Alternatively, as FIG. 11 shows, the inner tube 30 can also be provided with undercuts 31, which engage with pivoting hook elements 32 for axial fixation, being arranged on the outside of the tube 29. Conversely, the hook elements 32 can also be arranged on the inner tube 30 and the undercuts 31 on the tube 29.

Figure 12:
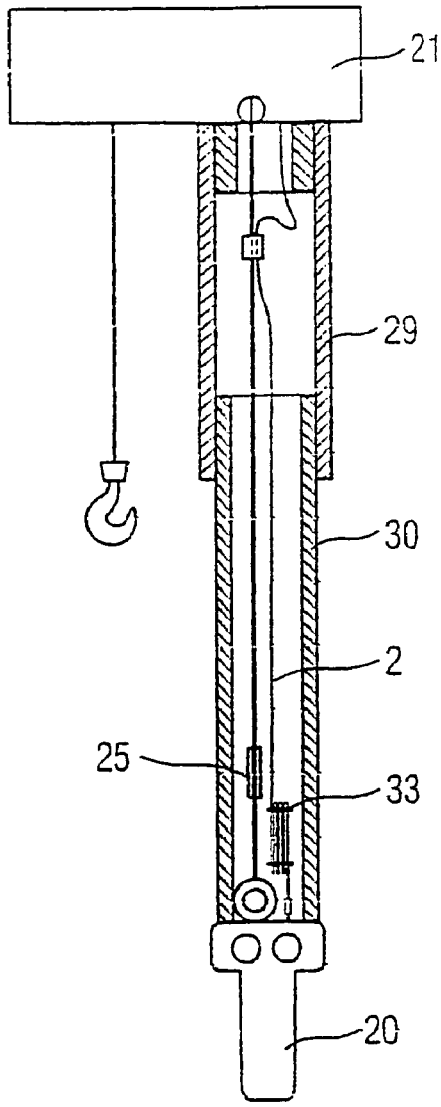
FIG. 12 is an illustration of a suspended control device with a winding frame carrier element.

A modification of the suspended control device 20 of FIG. 10 is shown in FIG. 12, where the electrical lines 2 are wound about a carrier element 33 in the manner of a winding frame inside the two tubes 29, 30. Height adjustment is done with a clamping plate 25*a* for clamping the steel rope together.

Figure 13:
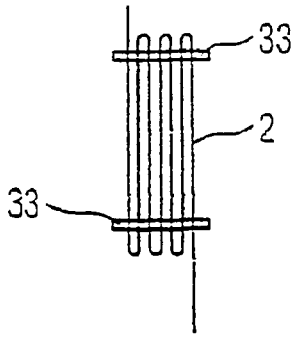
FIG. 13 is an enlarged representation of the carrier element per FIG. 12.

An enlarged view of the carrier element 33 in the manner of a winding frame is shown in FIG. 13.

Figure 14:
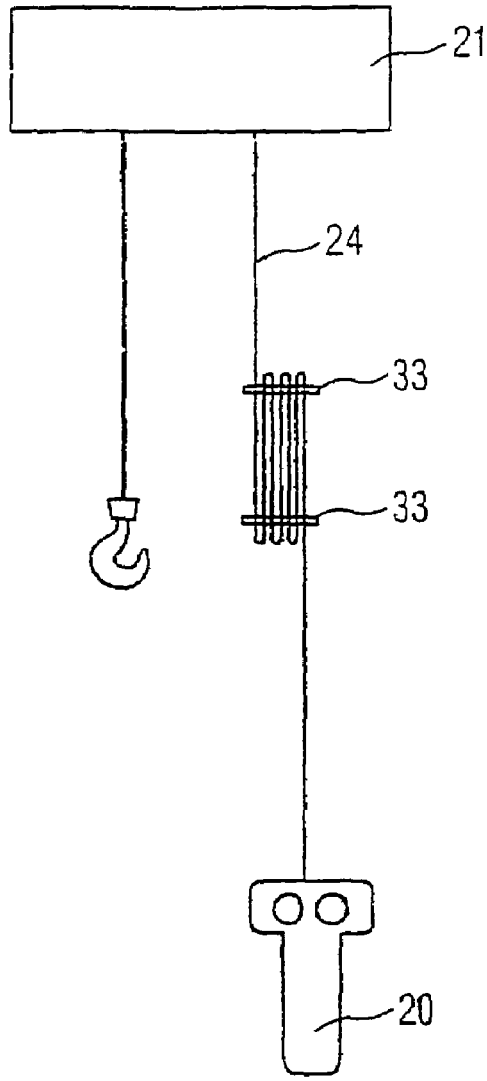
FIG. 14 is an illustration of a suspended control device without tubes, but with a carrier element in the form of a winding frame.

In the suspended control device 20 of FIG. 14, the cablelike traction relief 22 and the electrical lines 2 are fashioned as a common flat cable, so that the tubes of FIG. 10 and FIG. 12 can be omitted, and the storage for the cable is formed in that the cable is wound around a carrier element 33 in the manner of a winding frame.

Figure 15:
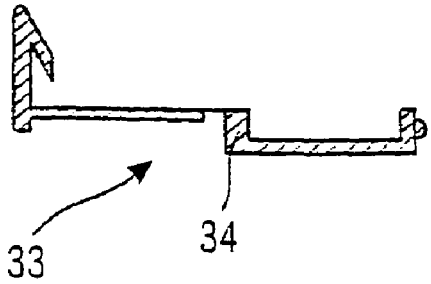
FIG. 15 is an enlarged representation of the carrier element per FIG. 14 as a film-hinge cable clamp.

The carrier element 33 is configured as a cable clamp 34 in the manner of a film joint 34, as shown in FIG. 15.

LIST OF REFERENCE NUMBERS

1 Control line
2 Electrical lines
3 Cable
4 Connector
5 Connector
6 Hose
7 Support element
8 Truncated cone
9 Funnel
10 Element
10*a* Guide pin
11 Gripping region
12 Hollow cylinder
13 Lengthwise slit
14 Cable storage
15 Lug
16 Continuous opening
17
18
19
20 Suspended control device
21 Unit
22 Traction relief
22*a* Turnaround point
22*b* Turnaround point
23 Clamp
24 Control line
25 Gravity force
26 Deflection roller
27 Cable drum
28 Support element
29 Tube
30 Inner tube
31 Undercut
32 Hook element
33 Carrier element
34 Cable clamp
35 Plug

The invention claimed is:

1. A suspension for a suspended control device which is suspended from a unit being controlled of a hoisting machine, wherein the suspension height of the suspended control device is adjustable in relation to the unit being controlled, said suspension comprising:

a control line comprising electrical lines for transmission of control signals and a traction relief, a top portion of said control line being supported at the unit being controlled in order to absorb gravity and traction forces; and a storage including the electrical lines and the traction relief, said storage being operable to take up and pay out predetermined lengths of both the electrical lines and the traction relief for adjusting the suspension height of the suspended control device, wherein said storage is located between the suspended control device and the unit being controlled.

2. A suspension for a suspended control device which is suspended from a unit being controlled of a hoisting machine, wherein the suspension height of the suspended control device is adjustable in relation to the unit being controlled, said suspension comprising:

a control line comprising electrical lines for transmission of control signals and a traction relief, a top portion of said control line being supported at the unit being controlled in order to absorb gravity and traction forces;

a storage for the electrical lines in order to take up and pay out a predetermined line length for adjusting the suspension height of the suspended control device, wherein said storage is located behind a support of said traction relief as viewed from the suspended control device toward the unit being controlled; and wherein said traction relief is formed from a flat foldable hose comprising a textile hose and said electrical lines run through the inside of said textile hose and said textile hose can be folded and stored along with said electrical lines in said storage.

3. The suspension for a suspended control device per claim 2, wherein said textile hose is filled with an elastic material in an operator gripping region.

4. The suspension for a suspended control device per claim 3, wherein said elastic material forms a lengthwise slit hollow cylinder defining a cavity for routing of said electrical lines.

5. The suspension for a suspended control device per claim 3, wherein said elastic material is formed from a foam plastic.

6. The suspension for a suspended control device per claim 2, wherein said textile hose extends through a hollow cylinder made from an elastic material in an operator gripping region.

7. The suspension for a suspended control device per claim 2, including a support device supporting said textile hose on the unit being controlled, wherein said support device uniformly distributes the gravity and traction forces about the periphery of said textile hose.

8. The suspension for a suspended control device per claim 7, wherein said support device is formed from a truncated cone arranged inside said textile hose with a continuous opening for said electrical lines and a funnel arranged outside said textile hose and supported on the unit being controlled, said funnel corresponding to the shape of the truncated cone, wherein the truncated cone is pulled by the gravity and traction forces into said funnel and thus axially secures the textile hose on the unit.

9. The suspension for a suspended control device per claim 8, wherein at least one part of said funnel is part of the unit being controlled.

10. The suspension for a suspended control device per claim 8, wherein said truncated cone and said funnel are each lengthwise divided and formed from two mating halves.

11. The suspension for a suspended control device per claim 8, wherein downward displacement of said truncated cone is limited by said funnel and upward displacement of said truncated cone is limited by a lug on said funnel.

12. The suspension for a suspended control device per claim 7, wherein said support device includes an element comprising inwardly directed lugs engaging said truncated cone, said element being operable to push said truncated cone upward from the outside in order to release the axial fixation of the textile hose.

13. The suspension for a suspended control device per claim 12, wherein said element is guided lengthwise through said funnel.

14. The suspension for a suspended control device per claim 2, wherein said storage is located between a support of said traction relief and the unit being controlled.

15. A suspension for a suspended control device which is suspended from a unit being controlled of a hoisting machine, wherein the suspension height of the suspended control device is adjustable in relation to the unit being controlled, said suspension comprising:

a control line comprising electrical lines for transmission of control signals and a traction relief, a top portion of said control line being supported at the unit being controlled in order to absorb gravity and traction forces;

a storage including the electrical lines and the traction relief said storage being operable to take up and pay out predetermined lengths of both the electrical lines and the traction relief for adjusting the suspension height of the suspended control device, wherein said storage is located between the suspended control device and the unit being controlled;

wherein said traction relief and said electrical lines extend down from the unit being controlled, back up at a lower turnaround point and again down via a turnaround element toward the suspended control device, said traction relief being connected to the suspended control device; and wherein said traction relief and said electrical lines are clamped together at said lower turnaround point by a detachable clamp.

16. The suspension for a suspended control device per claim 15, wherein said traction relief and said electrical lines are formed as a common flat cable, in which said traction relief is in the form of steel ropes at both sides of said electrical lines.

17. The suspension for a suspended control device per claim 15, including a gravity operated deflection roller at said lower turnaround point, wherein said turnaround element comprises a deflection roller.

18. The suspension for a suspended control device per claim 17, wherein an end portion of said flat cable connected to the suspended control device is adapted to be clamped to a weight element that produces a gravity force.

19. The suspension for a suspended control device per claim 18, wherein said end portion of said flat cable extends through a continuous opening provided in said weight element and is adapted to be fixed in said continuous opening.

20. A suspension for a suspended control device which is suspended from a unit being controlled of a hoisting machine, wherein the suspension height of the suspended control device is adjustable in relation to the unit being controlled, said suspension comprising:

a control line comprising electrical lines for transmission of control signals and a traction relief, a top portion of said control line being supported at the unit being controlled in order to absorb gravity and traction forces;

a storage including the electrical lines and the traction relief, said storage being operable to take up and pay out predetermined lengths of both the electrical lines and the traction relief for adjusting the suspension height of the suspended control device, wherein said storage is located between the suspended control device and the unit being controlled; and wherein said traction relief and said electrical lines are fashioned as a common cable, said cable being detachably fastened to a support element arranged at the unit, wherein said support element has two neighboring continuous openings with a land element between the openings, said cable being routed through the openings for self clamping fixation.

21. The suspension for a suspended control device per claim 20, wherein said support element is platelike.

22. A suspension for a suspended control device which is suspended from a unit being controlled of a hoisting machine, wherein the suspension height of the suspended control device is adjustable in relation to the unit being controlled, said suspension comprising:

a control line comprising electrical lines for transmission of control signals and a traction relief, a top portion of said control line being supported at the unit being controlled in order to absorb gravity and traction forces;

a storage including the electrical lines and the traction relief, said storage being operable to take up and pay out predetermined lengths of both the electrical lines and the traction relief for adjusting the suspension height of the suspended control device, wherein said storage is located between the suspended control device and the unit being controlled; and wherein said electrical lines are routed on the inside of a substantially vertical tube that is fastened to the unit being controlled and a telescopic extending inner tube that is fastened to the suspended control device, said vertical tube and said inner tube being formed from plastic.

23. The suspension for a suspended control device per claim 22, wherein said electrical lines have a spiral shape.

24. The suspension for a suspended control device per claim 22, wherein one of said inner tube and said vertical tube includes undercuts adapted to be engaged by pivotable hook elements arranged on the other of said inner tube and said vertical tube, wherein said vertical tube and said inner tube are axially fixed when said hook elements are engaged.

25. The suspension for a suspension control device per claim 22, wherein said traction relief comprises a steel rope.

26. The suspension for a suspension control device per claim 22, wherein said electrical lines are wound about a carrier element comprising a winding frame.

27. A suspension for a suspended control device which is suspended from a unit being controlled of a hoisting machine, wherein the suspension height of the suspended control device is adjustable in relation to the unit being controlled, said suspension comprising:

a control line comprising electrical lines for transmission of control signals and a traction relief, a top portion of said control line being supported at the unit being controlled in order to absorb gravity and traction forces;

wherein said traction relief and said electrical lines comprise a common flat cable;

a storage including the electrical lines and the traction relief said storage being operable to take up and pay out predetermined lengths of both the electrical lines and the traction relief for adjusting the suspension height of the suspended control device, wherein said storage is located between the suspended control device and the unit being controlled; and wherein said cable is wound about a carrier element comprising a winding frame.

28. The suspension for a suspension control device per claim 27, wherein said carrier element comprises a cable clamp comprising a film joint.

* * * * *